United States Patent [19]

Phillips

[11] Patent Number: 4,991,713

[45] Date of Patent: Feb. 12, 1991

[54] SERVING TRAY APPARATUS

[76] Inventor: Frederick T. Phillips, 705 S. Adams, Mt. Pleasant, Mich. 48858

[21] Appl. No.: 500,534

[22] Filed: Mar. 26, 1990

[51] Int. Cl.[5] ..... B65D 77/06

[52] U.S. Cl. ..... 206/218; 220/23.8; 206/563

[58] Field of Search ..... 206/557, 562, 563, 564, 206/217, 218; 220/23.8, 23.83

[56] References Cited

U.S. PATENT DOCUMENTS

| | | | |
|---|---|---|---|
| 21,955 | 11/1858 | Grosholz | 206/218 |
| D. 211,532 | 6/1968 | Ashton | 220/23.83 X |
| D. 214,459 | 6/1969 | Stageberg | 220/23.83 X |
| 2,107,023 | 2/1938 | Bertsch | 220/23.8 |
| 2,652,702 | 9/1953 | Hintze | 206/558 X |
| 3,285,459 | 11/1966 | Gahm | 206/218 X |
| 3,942,671 | 3/1976 | Floriah | 220/23.8 |
| 4,208,006 | 6/1980 | Bixler et al. | 206/564 X |
| 4,219,144 | 8/1980 | Hagelberg | 206/564 X |
| 4,534,469 | 8/1985 | Elsmo | 206/218 X |
| 4,573,586 | 3/1986 | Helmer | 206/564 X |
| 4,684,013 | 8/1987 | Jacobs | 206/560 X |
| 4,765,463 | 8/1988 | Chanel | 206/564 X |
| 4,867,331 | 9/1989 | Task | 206/564 X |

FOREIGN PATENT DOCUMENTS

| | | | |
|---|---|---|---|
| 2381 | 10/1900 | Austria | 220/23.8 |
| 3615933 | 11/1987 | Fed. Rep. of Germany | 206/217 |
| 2121270 | 12/1983 | United Kingdom | 220/23.8 |

*Primary Examiner*—William I. Price

*Attorney, Agent, or Firm*—Leon Gilden

[57] ABSTRACT

An apparatus including a central tray with a planar floor, and the planar floor including an annular array of downwardly directed wells oriented orthogonally from a bottom surface of the floor and defining an arc less than 360 degrees to define a planar lower surface, with an angle of access to a central bottom surface of the floor between 60 and 110 degrees permitting a server to direct the server's hand to the central bottom surface of the floor for support and transport thereof. The wells are defined by a predetermined height and a predetermined diameter, and each include a concave well surface to provide a reservoir for fluid directed inadvertently into the wells, with a drainage aperture formed coaxially through each well floor. Cup members are provided and define a cylindrical configuration complementary to an interior configuration defined by each well, and include a pleated accordion upper surface to permit extension of each cup to accommodate a large measure of beverage and the like within each cup during periods of use, but when compacted, permit ease of storage and transport of the tray apparatus.

6 Claims, 4 Drawing Sheets

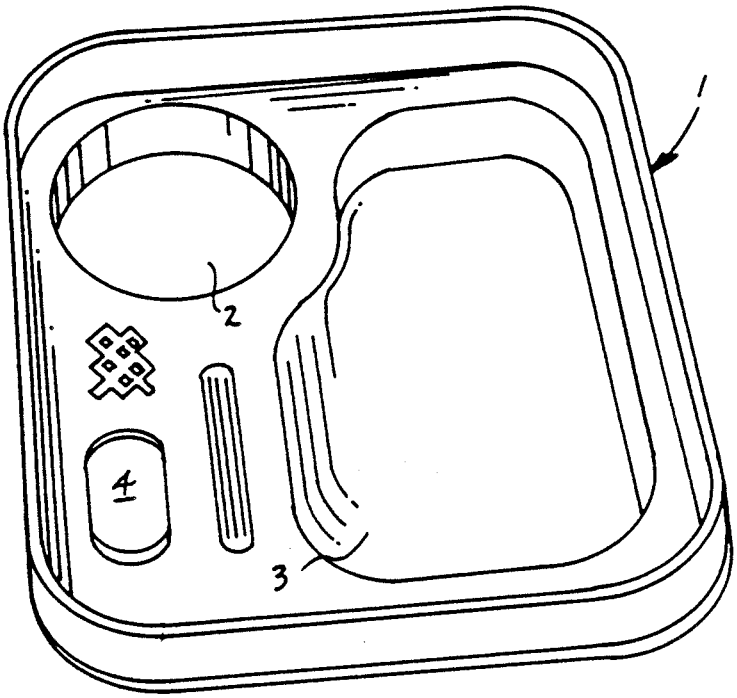
Fig 1
PRIOR ART
Fig 2
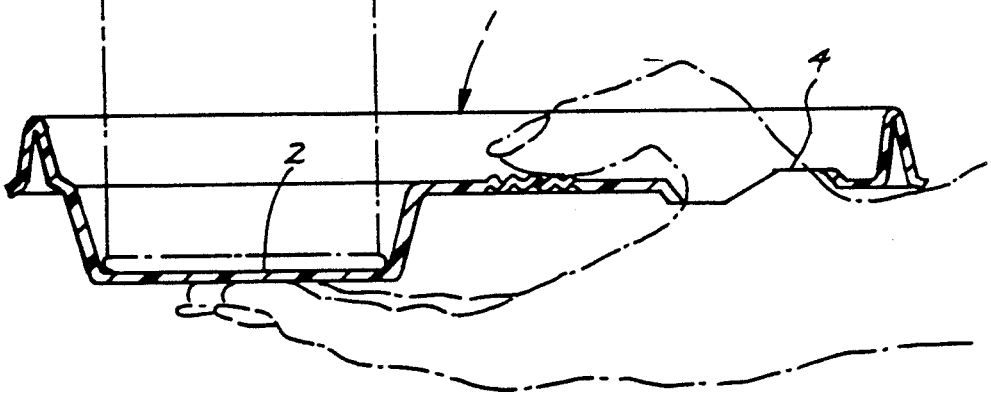
PRIOR ART

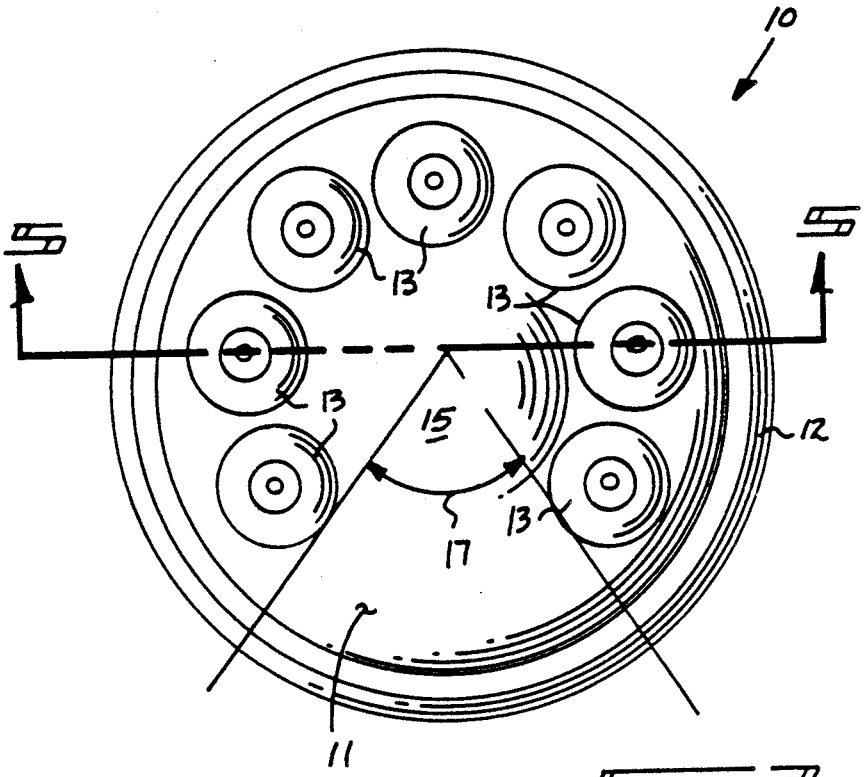
FIG 3
FIG 4
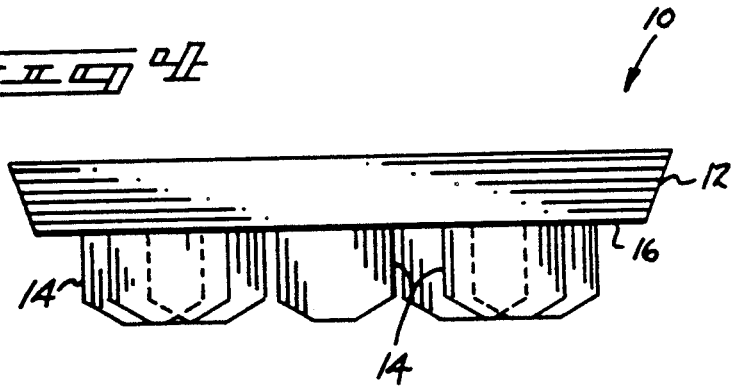

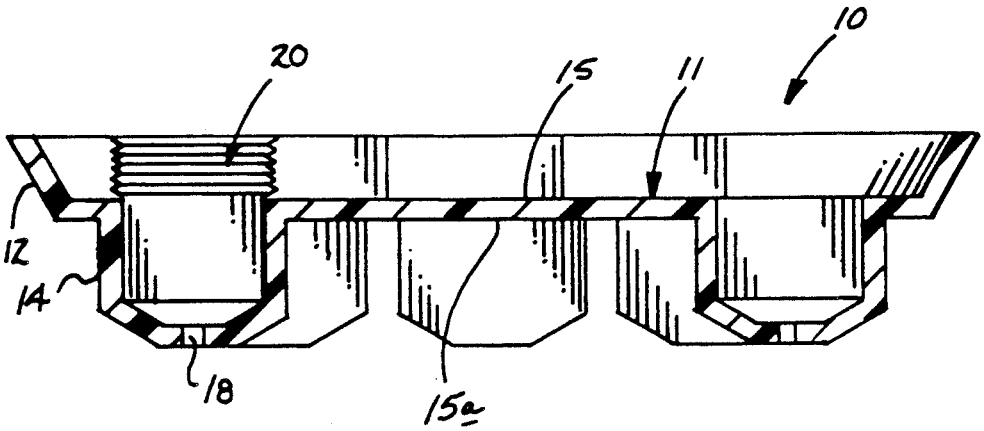
Fig 8
Fig 9
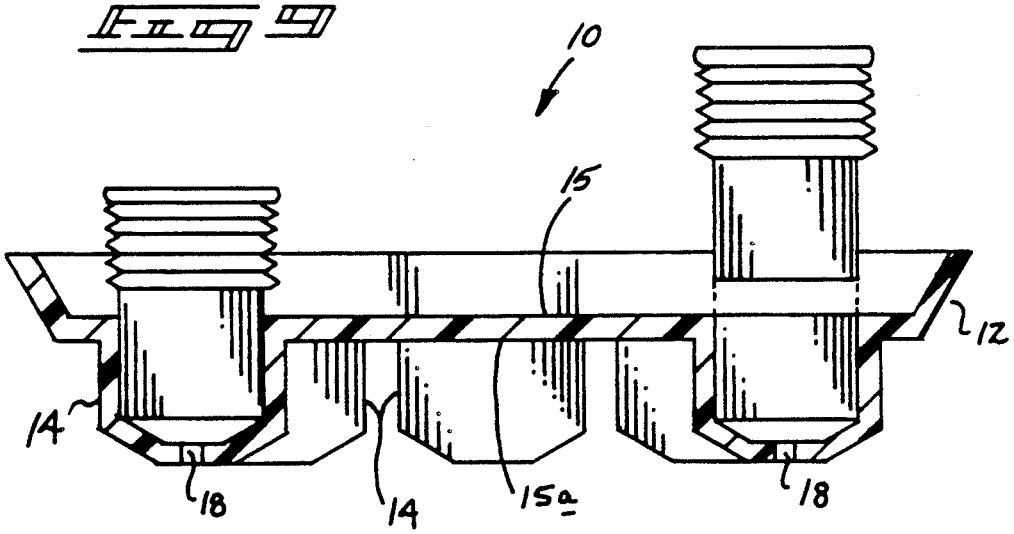

SERVING TRAY APPARATUS

BACKGROUND OF THE INVENTION

1. Field of the Invention

The field of invention relates to serving tray apparatus, and more particularly pertains to a new and improved serving tray apparatus wherein the same accommodates a partial annular array of cylindrical wells to accommodate fluid containing cups therewithin.

2. Description of the Prior Art

The prior art has provided a variety of various serving trays to accommodate various needs and conditions of individuals. The instant invention attempts to overcome deficiencies of the prior art wherein a variety of fluid beverages are positioned on a tray in a secure and fixed manner minimizing spillage of such beverages. Frequently in the prior art in the serving of fluid beverages in association with various snack-type foods, such beverages are subject to tippage and the like due to their relatively high center of gravity relative to a tray floor. Examples of prior art tray structures accommodating various foods and the like therewithin may be found in U.S. Pat. No. 4,684,013 to Jacobs wherein a generally rectangular tray mounts a complete matrix of cavities to receive flower-type pots therethrough.

U.S. Pat. No. 4,219,144 to Hagelberg sets forth a serving tray utilizing dissimilar cavities within the tray, with a through-extending aperture to permit directing of a server's thumb to enhance securement of the tray during transport.

U.S. Pat. No. 4,208,006 to Bixler, et al., sets forth a tray with forwardly positioned beverage wells and a central rearwardly oriented rectangular pocket to receive food components therewithin.

U.S. Pat. No. 4,765,463 to Chanel sets forth a display tray containing a series of well-like members coextensively throughout for reception of various food components therewithin.

U.S. Pat. No. 2,652,702 to Hintze sets forth a picnic-type tray and platter utilizing variously configured cavities and wells for receiving food components.

As such, it may be appreciated that there continues to be a need for a new and improved serving tray apparatus directed to the serving and support of various beverage containers in a partial annular array to provide a planar support floor and access thereto by an individual supporting and serving the associated tray and in this respect, the present invention substantially fulfills this need.

SUMMARY OF THE INVENTION

In view of the foregoing disadvantages inherent in the known types of serving tray apparatus now present in the prior art, the present invention provides a serving tray apparatus wherein the same positions beverage container wells and associated containers in a partial annular array through the tray to provide a central planar support surface and access thereto from a side wall of the tray. As such, the general purpose of the present invention, which will be described subsequently in greater detail, is to provide a new and improved serving tray apparatus which has all the advantages of the prior art serving tray apparatus and none of the disadvantages.

To attain this, the present invention provides an apparatus including a central tray with a planar floor, and the planar floor including an annular array of downwardly directed wells oriented orthogonally from a bottom surface of the floor and defining an arc less than 360 degrees to define a planar lower surface, with an angle of access to a central bottom surface of the floor between 60 and 110 degrees permitting a server to direct the server's hand to the central bottom surface of the floor for support and transport thereof. The wells are defined by a predetermined height and a predetermined diameter, and each include a concave well surface to provide a reservoir for fluid directed inadvertently into the wells, with a drainage aperture formed coaxially through each well floor. Cup members are provided and define a cylindrical configuration complementary to an interior configuration defined by each well, and include a pleated accordion upper surface to permit extension of each cup to accommodate a large measure of beverage and the like within each cup during periods of use, but when compacted, permit ease of storage and transport of the tray apparatus.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved serving tray apparatus which has all the advantages of the prior art serving tray apparatus and none of the disadvantages.

It is another object of the present invention to provide a new and improved serving tray apparatus which may be easily and efficiently manufactured and marketed.

It is a further object of the present invention to provide a new and improved serving tray apparatus which is of a durable and reliable construction.

An even further object of the present invention is to provide a new and improved serving tray apparatus which is susceptible of a low cost of manufacture with regard to both materials and labor, and which accordingly is then susceptible of low prices of sale to the consuming public, thereby making such serving tray apparatus economically available to the buying public.

Still yet another object of the present invention is to provide a new and improved serving tray apparatus which provides in the apparatuses and methods of the prior art some of the advantages thereof, while simultaneously overcoming some of the disadvantages normally associated therewith.

Still another object of the present invention is to provide a new and improved serving tray apparatus wherein the same accommodates various beverage containers and food components and permits support of the tray through a side wall of the tray by an individual permitting directing of the individual's hand in an unobstructed manner from a side wall of the tray to a central bottom surface thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art serving tray apparatus.

FIG. 2 is an orthographic cross-sectional view of the prior art serving tray apparatus of FIG. 1.

FIG. 3 is an orthographic plan view of the instant invention.

FIG. 4 is an orthographic side view, taken in elevation, of the instant invention.

FIG. 8 is an orthographic cross-sectional view of the cup member in a compressed configuration in association with the tray of the instant invention.

FIG. 9 is an orthographic cross-sectional view of cup members utilized by the instant invention in an extended configuration in association with the tray of the instant invention.

DESCRIPTION OF THE PREFERRED EMBODIMENT

Figure 5:
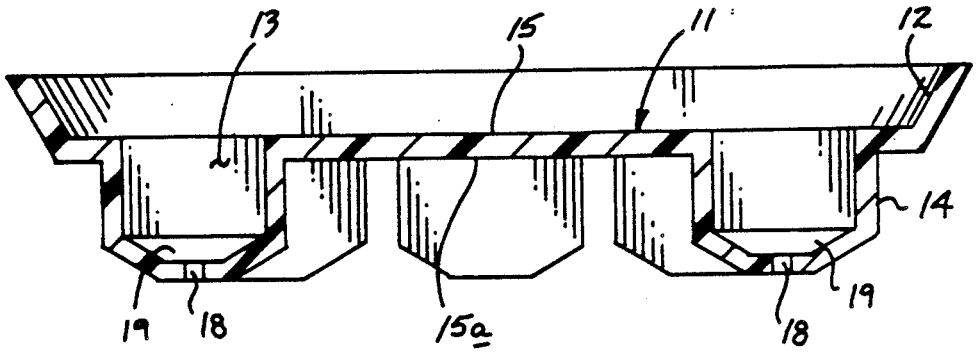
FIG. 5 is an orthographic cross-sectional view, taken along the lines 5—5 of FIG. 3, in the direction indicated by the arrows.

With reference now to the drawings, and in particular to FIGS. 1 to 9 thereof, a new and improved serving tray apparatus embodying the principles and concepts of the present invention and generally designated by the reference numeral 10 will be described.

FIG. 1 illustrates a prior art serving tray 1 utilizing a plurality of variously configured cavities 2 and 3 respectively, with a through-extending elongate aperture 4 for receiving an individual's thumb to permit enhanced securement of the tray during support and transport thereof by the individual.

More specifically, the serving tray apparatus 10 of the instant invention essentially comprises a tray floor 11 defined by a planar top surface overlying and spaced from a planar bottom surface. The tray floor 11 includes a surrounding wall 12 directed upwardly of the floor 11 inclined at an obtuse angle relatively thereto. A series of annular wells 13 are arranged in an annular array defining an annular sector of an angle ranging from 250 to 290 degrees of arc. The annular wells 13 are symmetrically and coaxially arranged relative to the floor 11, and define a central top surface 15 overlying a central bottom surface 15*a*. As the wells 14 project orthogonally downwardly from the bottom surface 15*a*, an unobstructed angle of entry 17 defining an angle between 60 and 110 degrees is defined between the end projecting annular wells 13 that are defined by the cylindrical well walls 14. This angle of entry 17, as illustrated in FIG. 3 for example, permits an individual to direct a hand between the forward and free wells 13 and position the hand comfortably within the bottom surface 15*a*. The central surface 15 permits positioning of various food commodities thereon while providing a storage of various food components about the surface of the floor 11 adjacent the various wells 13. Each of the cylindrical well walls 14 and the associated wells 13 define a concave floor 19 at each lowermost end of the well walls 14, with a drainage aperture 18 coaxially positioned within each concave floor 19, as illustrated in FIG. 5 for example. The concave floors 19 accordingly define a drainage reservoir for use in the event of inadvertent spillage of fluid within the tray and wells and permit such fluid to be directed exteriorly of the wells by the associated drainage apertures 18.

Figure 6:
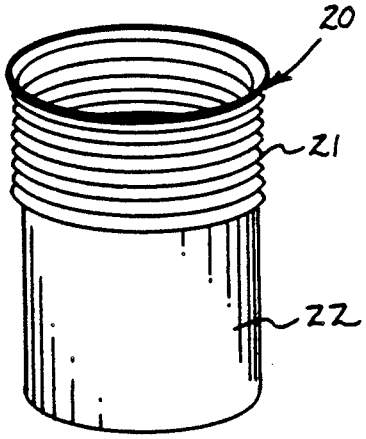
FIG. 6 is an isometric illustration of a cup member utilized in association with the instant invention and in an extended configuration.
Figure 7:
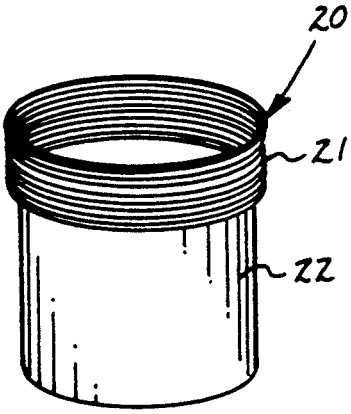
FIG. 7 is an isometric illustration of a cup member utilized by the instant invention in a retracted compressed configuration.

FIGS. 6 and 7 illustrate the use of collapsible cups 20 for use in combination with the instant invention, wherein the cups 20 are defined by a rigid lower cylindrical portion 22 defining an outer diameter substantially equal to the inner diameter of the wells 13 and are defined by a height equal to the predetermined height of the well walls 14 above the concave floors 19. The cups 20 include an accordion pleated upper portion 21 that is selectively extensible or retractable. When retractable, as illustrated in FIG. 8 for example, in a first position, the cups 20 do not extend above the associated surrounding wall 12. In use, the cups 20 may be extended by use of the accordion pleated portion 21 for securement of a full measure of a beverage fluid therewithin.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A serving tray apparatus comprising, a tray member including an annular floor, the annular floor including a top planar surface overlying a bottom planar surface, and a surrounding wall extending upwardly relative to the top surface in a surrounding relationship to the tray floor, and a plurality of annular wells arranged in an annular sector defined by a predetermined angle of arc directed downwardly and orthogonally relative to the floor, wherein the wells are arranged coaxially relative to the tray floor adjacent the surrounding wall, and wherein the annular wells are defined by a cylindrical annular well wall directed downwardly from the bottom surface of the floor, and each well includes a concave floor member, arranged at the lower terminal end of each well, and wherein each concave floor member includes a coaxially arranged drainage aperture positioned therewithin.

2. An apparatus as set forth in claim 1, wherein the predetermined angle of arc defines an angle between 250 and 290 degrees, and further defines an angle of entrance between the wells defined by the plurality of wells, wherein the angle of entrance is defined by an angle substantially equal to 60 to 110 degrees.

3. An apparatus as set forth in claim 2 wherein each cylindrical well wall is defined by a predetermined height and a predetermined internal diameter, and further including a plurality of cup members receivable within each well, wherein each cup member includes an annular lower portion and an extendible upper portion.

4. An apparatus as set forth in claim 3 wherein each annular lower portion is defined by a height equal to the predetermined height and defined by an external diameter equal to the internal diameter of each of the wells to permit complementary reception of each cup within each well.

5. An apparatus as set forth in claim 4 wherein each extendible upper portion is defined by an accordion pleated portion.

6. An apparatus as set forth in claim 5 wherein the accordion pleated portion is contractible to a first position and expandable to a second position, and the pleated portion in the first position is arranged to extend to or below the surrounding wall, and in the second position, arranged to extend above the surrounding wall.

* * * * *